US009557706B2

(12) United States Patent
Murakami

(10) Patent No.: US 9,557,706 B2
(45) Date of Patent: Jan. 31, 2017

(54) WASTE TONER COLLECTION CONTAINER AND IMAGE FORMING APPARATUS

(71) Applicant: CASIO COMPUTER CO., LTD., Shibuya-ku, Tokyo (JP)

(72) Inventor: Taichi Murakami, Hino (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/830,520

(22) Filed: Aug. 19, 2015

(65) Prior Publication Data

US 2016/0054701 A1 Feb. 25, 2016

(30) Foreign Application Priority Data

Aug. 22, 2014 (JP) ..... 2014-169431

(51) Int. Cl.
*G03G 21/12* (2006.01)

(52) U.S. Cl.
CPC ..... *G03G 21/12* (2013.01)

(58) Field of Classification Search
CPC ..... G03G 21/10; G03G 21/105
See application file for complete search history.

(56) References Cited

U.S. PATENT DOCUMENTS 4,761,674 A * 8/1988 Ogura ..... G03G 21/12 399/35
6,660,947 B1 * 12/2003 Badescu ..... H01H 25/06 200/4
7,231,157 B2 6/2007 Kitayama
7,792,458 B2 9/2010 Ota
8,594,519 B2 11/2013 Nakatake et al.
2004/0190918 A1 * 9/2004 Park ..... G03G 15/553 399/35
2010/0166441 A1 * 7/2010 Kobayashi ..... G03G 21/12 399/35
2011/0243585 A1 * 10/2011 Mizutani ..... G03G 15/0856 399/35
2014/0112673 A1 * 4/2014 Sayama ..... G03G 21/12 399/35

FOREIGN PATENT DOCUMENTS

JP 2005316064 A 11/2005
JP 2007024971 A 2/2007
JP 2009020187 A 1/2009
JP 2011164334 A 8/2011

* cited by examiner

*Primary Examiner* — Clayton E Laballe
*Assistant Examiner* — Victor Verbitsky
(74) *Attorney, Agent, or Firm* — Holtz, Holtz & Volek PC

(57) ABSTRACT

A waste toner collection container includes a housing main body, a detection chamber with an opening and a waste toner introduction inhibition member. The housing main body collects waste toner therein. The detection chamber engages with the housing main body and enables a sensor to determine whether the waste toner reaches a predetermined amount, by interrupting a light path of the sensor. The opening opens toward the housing main body. The waste toner introduction inhibition member seals the opening to inhibit the waste toner in the housing main body from being introduced into the detection chamber before the waste toner in the housing main body reaches the predetermined amount, and is fractured by a pressing force of the waste toner to permit the waste toner to be introduced into the detection chamber as the waste toner in the housing main body reaches the predetermined amount.

8 Claims, 7 Drawing Sheets

WASTE TONER COLLECTION CONTAINER AND IMAGE FORMING APPARATUS

CROSS-REFERENCE TO RELATED APPLICATION

The present application claims the priority of Japanese Patent Application No. 2014-169431 filed on Aug. 22, 2014, the contents of which being here incorporated for reference.

FIELD OF THE INVENTION

The invention relates to a waste toner collection container and an image forming apparatus using the same.

DESCRIPTION OF THE RELATED ART

In the related art, there is an electrophotographic image forming apparatus. The electrophotographic image forming apparatus has at least a photosensitive member configured to carry thereon a toner image, which is obtained by developing an electrostatic latent image by toner, and a transfer belt configured to directly or indirectly transfer the toner image carried on the photosensitive member to a recording medium.

The toner, which has not been transferred to the transfer belt, remains on the photosensitive member. The remaining toner is collected to a photosensitive member cleaner, as waste toner. Also, the toner, which has not been transferred to the recording medium, remains on the transfer belt, too. The remaining toner is collected to a belt cleaner, as waste toner.

The waste toner collected at the photosensitive member cleaner and belt cleaner is again collected to a waste toner collection container through a waste toner conveying pipe and the like. The waste toner collection container in which the collected waste toner exceeds a predetermined amount is removed and discarded from the image forming apparatus. Then, a new waste toner collection container is mounted to the image forming apparatus.

Describing the waste toner collection container, it is necessary to detect without an error that the collected waste toner in the waste toner collection container exceeds the predetermined amount, before removing waste toner collection container from the image forming apparatus. If not, the waste toner collection container capable of still accommodating the waste toner is discarded, which causes the unnecessary waste.

As for a sensor configured to determine whether the toner exists, a technology of forming an airflow so that an air stream including toner particles does not pass to a detection surface of the sensor and making it difficult for foreign matters to adhere to the sensor is suggested (for example, JP-A-2005-316064). However, it is not possible to securely prevent the foreign matters from adhering.

Also, a technology of providing a plurality of sensors or detectors to increase parameters of detection values, to lower a probability that the sensor cannot be used due to the foreign matters sensor, and to prevent the detection reliability of the sensors from being lowered as a whole is suggested (for example, JP-A-2007-024971). The above technologies are to reduce the lowering of the detection reliability of the sensor due to the foreign matters adhering to the sensor.

BRIEF SUMMARY OF THE INVENTION

According to one aspect of the invention, a waste toner collection container includes a housing main body, a detection chamber, an opening and a waste toner introduction inhibition member. The housing main body collects waste toner in the housing main body. The detection chamber engages with an inner-upper opening of the housing main body and enables an outside sensor to determine whether the waste toner in the housing main body reaches a predetermined amount, by interrupting a light path of the sensor. The opening is formed at the detection chamber and opens toward an inside of the housing main body. The waste toner introduction inhibition member is arranged to seal the opening. The waste toner introduction inhibition member is configured to inhibit the waste toner falling in an internal space of the housing main body from being introduced into the detection chamber before the waste toner in the housing main body reaches the predetermined amount. The waste toner introduction inhibition member is configured to be fractured by a pressing force of the waste toner toward the detection chamber and to permit the waste toner to be introduced into the detection chamber as the waste toner in the housing main body reaches the predetermined amount.

According to another aspect of the invention, a waste toner collection container includes a housing main body, a detection chamber, an interruption member, an opening and a waste toner introduction inhibition member. The housing main body collects waste toner in the housing main body. The detection chamber is arranged at an inner-upper part of the housing main body and enables an outside sensor to determine whether the waste toner in the housing main body reaches a predetermined amount, by interrupting a light path of the sensor. The interruption member is arranged in the detection chamber and is rotatable between a non-interruption position and an interruption position with respect to the light path of the sensor. The opening is formed at the detection chamber and opens toward an inside of the housing main body. The waste toner introduction inhibition member is arranged to seal the opening. The waste toner introduction inhibition member is configured to keep a predetermined shape thereof so that the interruption member is located at the non-interruption position before the waste toner in the housing main body reaches the predetermined amount. The waste toner introduction inhibition member is configured to be deformed so as to rotate the interruption member to the interruption position by a pressing force of the waste toner toward the detection chamber as the waste toner in the housing main body reaches the predetermined amount.

Further, according to another aspect of the invention, an image forming apparatus includes the above waste toner collection container, a sensor and a control unit. The sensor determines whether the interruption member in the detection chamber interrupts a transmission of light in the light path of the sensor. The control unit includes an input port which receives an output signal of the sensor. The control unit enables a notifying device to notify an outside that the waste toner in the waste toner collection container reaches the predetermined amount, based on the signal input to the input port.

BRIEF DESCRIPTION OF THE DRAWINGS

FIG. 7A and FIG. 7B illustrate operating states of an interruption member of the detection chamber of the waste toner collection container according to the second illustrative embodiment, together with the waste toner, in which FIG. 7A illustrates a state before the waste toner in a housing main body reaches a predetermined amount, and FIG. 7B illustrates a state at the time that the waste toner in the housing main body reaches the predetermined amount.

DETAILED DESCRIPTION OF THE INVENTION

Hereinafter, illustrative embodiments of the present invention will be described in detail with reference to the drawings. Meanwhile, in below descriptions, the terms 'printing' and 'print' are used as the same meaning.

[First Illustrative Embodiment]

Figure 1:
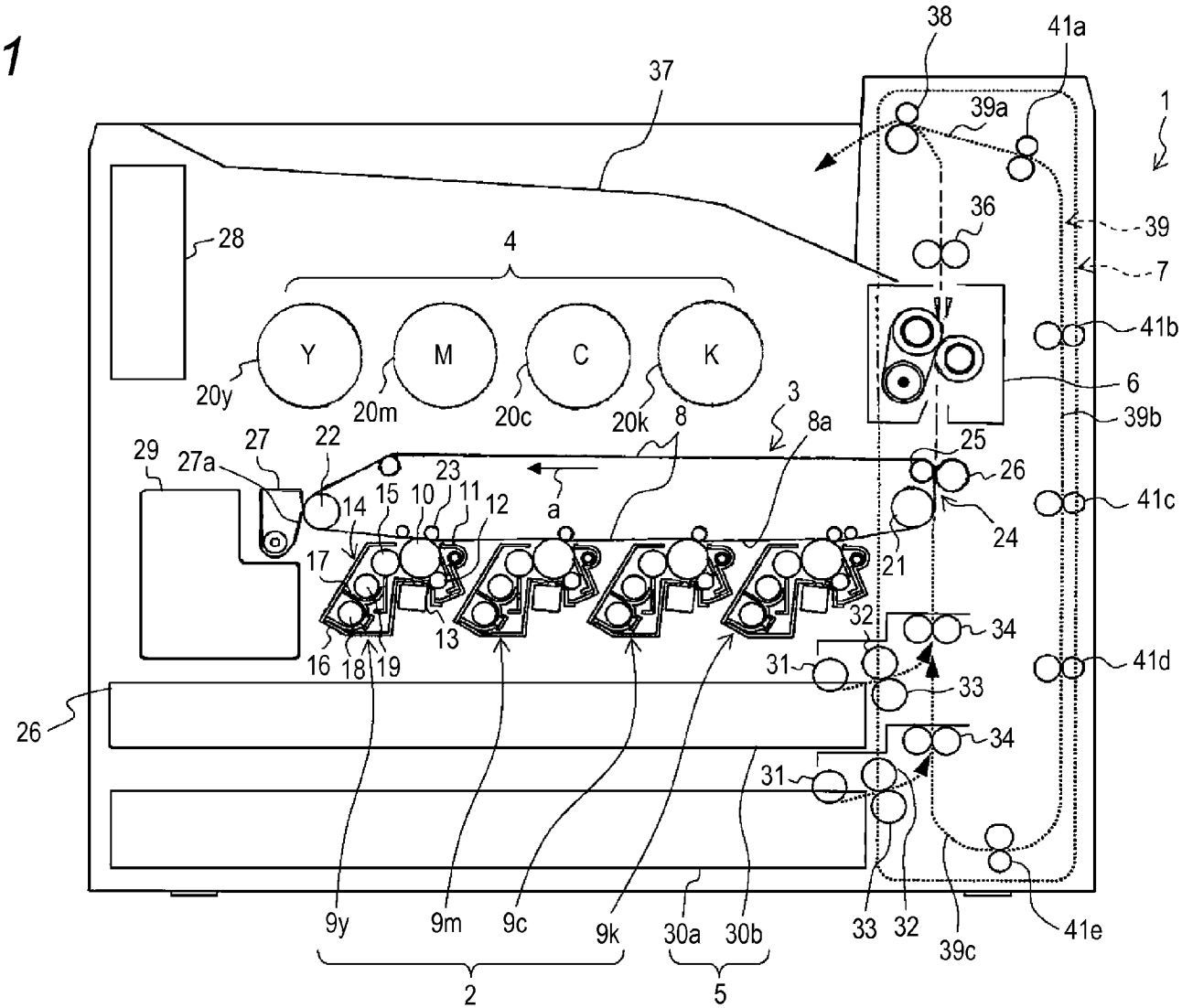
FIG. 1 is a sectional view illustrating an internal configuration of a full-color image forming apparatus (printer, apparatus main body) having a waste toner collection container according to a first illustrative embodiment of the present invention.

FIG. 1 is a sectional view illustrating an internal configuration of a full-color image forming apparatus (hereinafter, simply referred to as printer) having a waste toner collection container according to a first illustrative embodiment of the present invention.

The printer 1 (hereinafter, also referred to as an apparatus main body 1) shown in FIG. 1 is an electrophotographic color image forming apparatus of a secondary transfer tandem type, and has an image forming device 2, a transfer belt unit 3, a toner supply unit 4, a feeder unit 5, a belt-type fixing device 6, and a conveyance unit 7 for duplex printing.

The image forming device 2 is a so-called backside transfer-type, and has four image forming units 9 (9*k*, 9*c*, 9*m*, 9*y*) arranged side by side in a multi stage form from a downstream side to an upstream side (from right to left in FIG. 1), which are in contact with a lower traveling surface 8*a* of the transfer belt 8, so as to transfer a toner image to the lower traveling surface 8*a*.

The three upstream-side image forming units 9*y*, 9*m*, 9*c* of the four image forming units 9 are configured to form a mono-color image by color toners of yellow (Y), magenta (M) and cyan (C), which are three subtractive primary colors.

Also, the image forming unit 9*k* is configured to form a monochrome image by black toner (K), which is mainly used for a character, a black part of an image, and the like. The respective image forming units 9 have the same configuration, except for colors of toners for image developing. Therefore, in the below, the corresponding configuration is described with reference to the image forming unit 9*y* for yellow (Y) toner.

The image forming unit 9 has a photosensitive drum 10 at the uppermost part. A cleaner 11 of a drum unit 10, a charging roller 12, an optical writing head 13 of an apparatus main body-side and a developing roller 15 of a developing unit 14 are arranged to contact a circumferential surface of the photosensitive drum 10 or to surround vicinity thereof.

The cleaner 11 has therein a conveying screw (screw) and is configured to send waste toner removed from the circumferential surface of the photosensitive drum 10 and staying on a bottom to a waste toner conveyance unit (which will be described later). The waste toner conveyance unit is configured to convey the waste toner to a waste toner collection container 29.

Meanwhile, in FIG. 1, since the waste toner conveyance unit is arranged on a back surface of the transfer belt unit 3, i.e., at an opposite side of the drawing sheet in a depth direction, the waste toner conveyance unit is concealed by the transfer belt unit 3 and is not seen.

The developing unit 14 has an external unit housing 16, an internal partition wall 17, and first and second agitation conveying screws 18, 19 respectively arranged in upper and lower developer tanks partitioned by the partition wall 17.

To the developing unit 14, any one toner of yellow(Y), magenta(M) cyan(C) and black(K) toners denoted with Y, M, C, K in FIG. 1 is supplied from a toner supply container 20 (20*y*, 20*m*, 20*c*, 20*k*) of the toner supply unit 4.

The transfer belt unit 3 has the endless transfer belt 8, which extends in a flat loop shape in a right and left direction of FIG. 1 at a substantial center of the apparatus main body, and a driving roller 21 and a driven roller 22, on which the transfer belt 108 is put and which are configured to circulate the transfer belt 8 in a counterclockwise direction denoted with an arrow 'a' in FIG. 1.

A primary transfer roller 23 is integrally incorporated to the transfer belt 8. The primary transfer roller 23 is pressed against the photosensitive drum 10 via the transfer belt 8, and is configured to directly transfer (primarily transfer) a toner image to the lower traveling surface 8*a* of the transfer belt 8 circulating below.

The transfer belt 8 further conveys a sheet to a secondary transfer unit 24 so as to transfer the toner image to the sheet (secondary transfer). The secondary transfer unit 24 has an auxiliary transfer roller 25 arranged in the vicinity of the driving roller 21 at a downstream side (upper side in FIG. 1), and a secondary transfer roller 26 pressed against the auxiliary transfer roller 25 via the transfer belt 8.

A belt cleaner 27 is arranged at the transfer belt 8. The belt cleaner 27 has a cleaning blade 27*a* configured to contact a surface of the transfer belt 8 put on the driven roller 22. Also, the waste toner collection container 29 is detachably arranged to be adjacent from left of the belt cleaner 27 to below.

The belt cleaner 27 is configured to scrape and remove the waste toner staying on the surface of the transfer belt 8 by the cleaning blade 27*a*, and to send the waste toner to the waste toner collection container 29 through the waste toner conveyance unit.

An electrical unit 28 is arranged above the waste toner collection container 29. The electrical unit 28 is mounted with a circuit board having a control device consisting of a plurality of electronic components mounted thereon.

The toner supply unit 4 has four toner supply containers 20 (20*y*, 20*m*, 20*c*, 20*k*) detachably arranged above an upper traveling part of the transfer belt 8. As described above, yellow (Y), magenta (M), cyan (C) and black (K) toners are accommodated in the four toner supply containers 20.

The four toner supply containers 20 are respectively coupled to the developing units 14 of the corresponding image forming units 9 via toner supply paths leading to toner supply ports of a mounting unit, although it is concealed at the opposite side of the transfer belt unit 3 and is not seen in FIG. 1.

The feeder unit 5 has two sheet feeding cassettes 30 (30*a*, 30*b*) arranged in two upper and lower stages. In the vicinity of sheet feeding openings (right in FIG. 1) of the two sheet feeding cassettes 30, a sheet pickup roller 31, a feeding roller 32, a separation roller 33, and a pair of standby conveyance rollers 34 are arranged, respectively.

In a sheet conveying direction (vertically upper direction, in FIG. 1) of the standby conveyance rollers 34, the secondary transfer unit 24 for the sheet is formed by the transfer belt 8, the auxiliary transfer roller 25 and the secondary transfer roller 26.

The belt-type fixing device (hereinafter, simply referred to as fixing device) 6 is arranged downstream (upper side in FIG. 1) of the secondary transfer unit 24, and a pair of carrying-out rollers 36 configured to carry out the sheet from the fixing device 6 after the fixing and a pair of sheet discharge rollers 38 configured to discharge the carried-out sheet to a sheet discharge tray 37 formed on an upper surface of the apparatus are arranged further downstream of the fixing device 6.

The conveyance unit 7 for duplex printing has a conveyance path 39 having a conveyance start path 39*a* branching from a portion just before the sheet discharge rollers 38 in a rightward lateral direction of FIG. 1, a conveyance intermediate path 39*b* bent downwards from the conveyance start path 39*a* and a conveyance end path 39*c* bent in a leftward lateral direction and configured to reverse the sheet being conveyed.

Also, five sets of conveyance rollers 41 (41*a*, 41*b*, 41*c*, 41*d*, 41*e*) are arranged on the way of the conveyance path 39. An exit of the conveyance end path 39*c* converges to a conveyance path toward the standby conveyance rollers 34 corresponding to the lower sheet feeding cassette 30*b* of the feeder unit 5.

Figure 2:
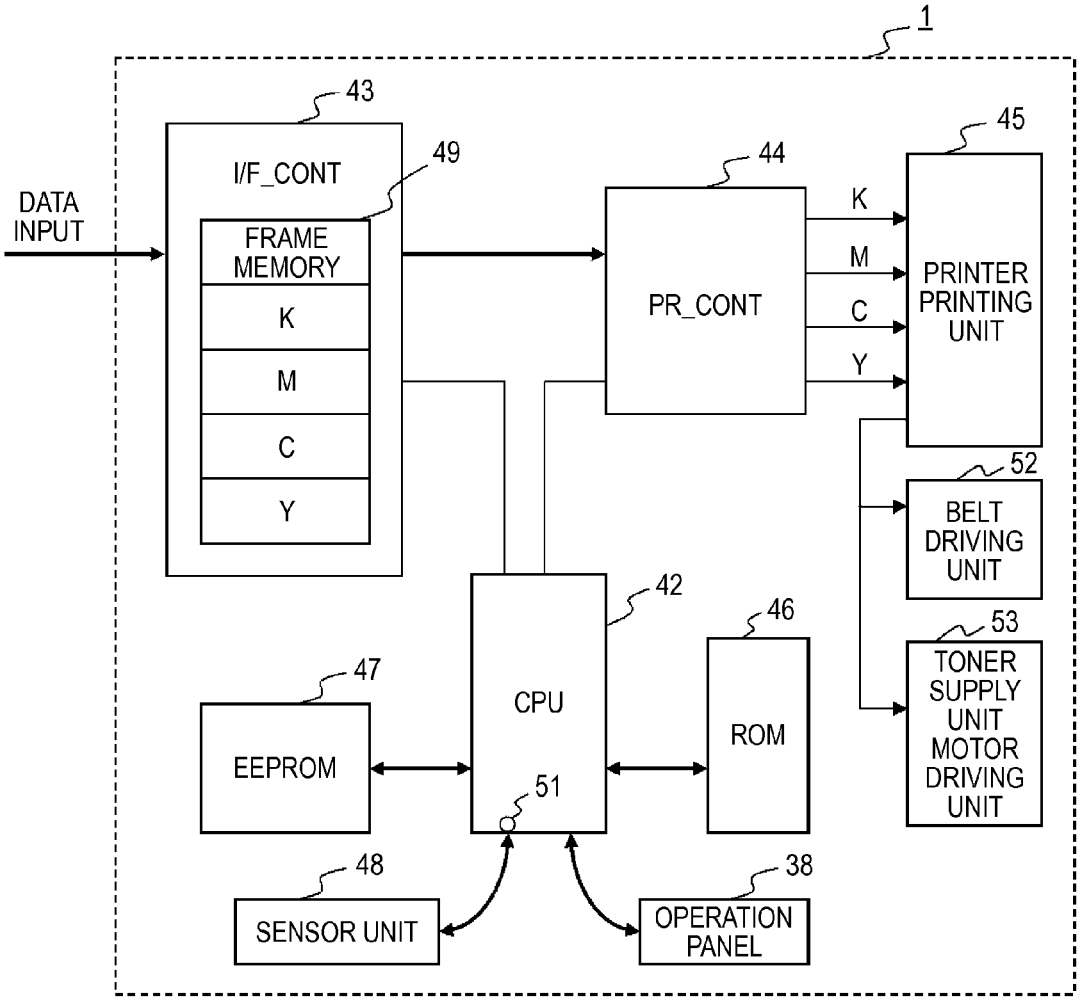
FIG. 2 is a circuit block diagram including a control device of the printer according to the first illustrative embodiment.

FIG. 2 is a circuit block diagram including the control device of the printer 1. As shown in FIG. 2, the circuit block has a CPU (central processing unit) 42 to which an interface controller (I/F_CONT) 43 and a printer controller (PR_CONT) 44 are connected via data buses, respectively. The PR_CONT 44 is connected with a printer printing unit 45.

Also, the CPU 42 is connected with a ROM (read only memory) 46, an EEPROM (electrically erasable programmable ROM) 47, an operation panel 38 of a main body operation unit, and a sensor unit 48 to which outputs from sensors arranged at the respective units are input. The sensor unit 48 is connected to an input port 51 of the CPU 42.

In the ROM 46, a system program is stored. The CPU 42 is configured to control the respective units and to perform the processing, in response to the system program.

That is, in the respective units, the I/F_CONT 43 is configured to convert print data supplied from a host computer such as a PC into bitmap data and to develop the same into a frame memory 49. In the frame memory 49, storage areas are set for each of black (K), magenta (M), cyan (C) and yellow (Y), and data of each color is developed into the corresponding area.

The data developed into the frame memory 49 is output to the PR_CONT 44, and is output from the PR_CONT 44 to the printer printing unit 45.

The printer printing unit 45 is an engine unit, and has a driving unit (not shown) configured to drive a rotary driving system (not shown) including the photosensitive drum 10, the primary transfer roller 21 and the like (FIG. 1), the image forming device including a driven unit such as the charging roller 12, the optical recording head 13 and the like, the upward and downward movement of the transfer belt unit 3 and the rotation of the transfer belt 8, under control from the PR_CONT 44.

Further, the printer printing unit 45 has a belt driving unit 52 configured to perform the belt driving of the belt-type fixing unit 6, and a toner supply unit motor driving unit 53 configured to drive a motor of the developing unit 14.

Also, the printer printing unit 45 is configured to control driving outputs to process loads of the conveyance mechanism including the respective units to be rotated such as the sheet pickup roller 31 to the sheet discharge rollers 38, the belt-type fixing unit 6 configured to generate heat and to rotate, and the like.

The print data of the respective colors of black (K), magenta (M), cyan (C) and yellow(Y), which is output from the PR_CONT 44, is supplied from the printer printing unit 45 to the corresponding optical recording heads 13 (FIG. 1), respectively.

Figure 3A:
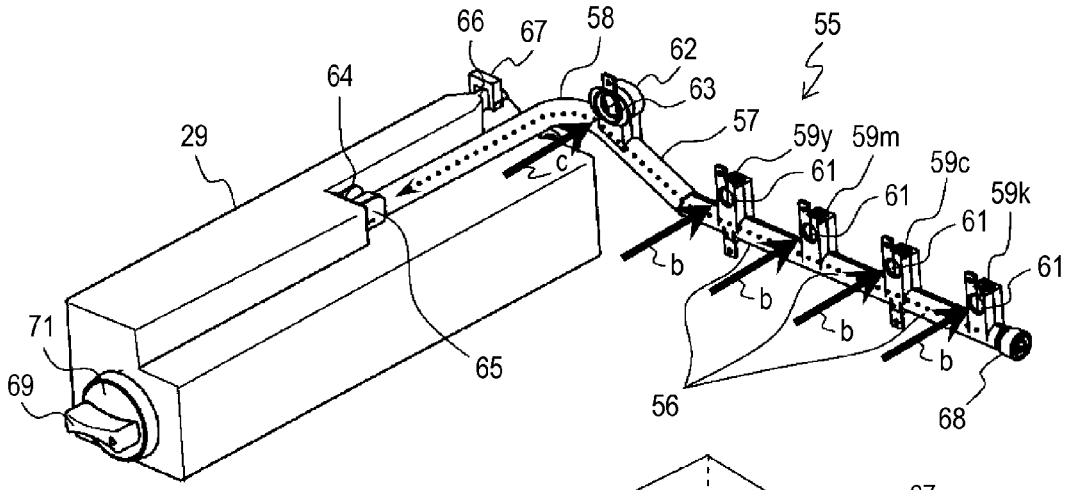
FIG. 3A is a perspective view illustrating only the waste toner collection container and waste toner conveyance unit taken from the printer having the waste toner collection container according to the first illustrative embodiment.
Figure 3B:
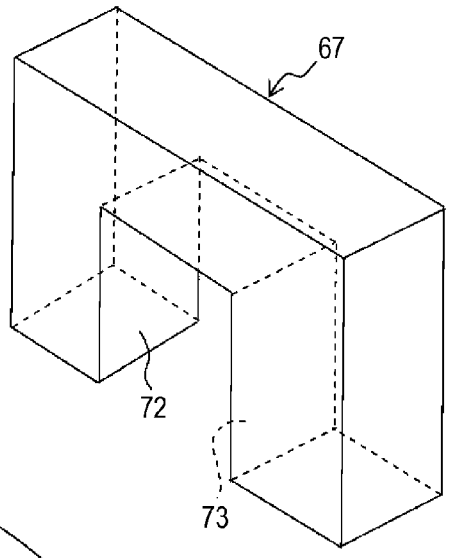
FIG. 3B is an enlarged perspective view of a waste toner fullness sensor of FIG. 3A.
Figure 3C:
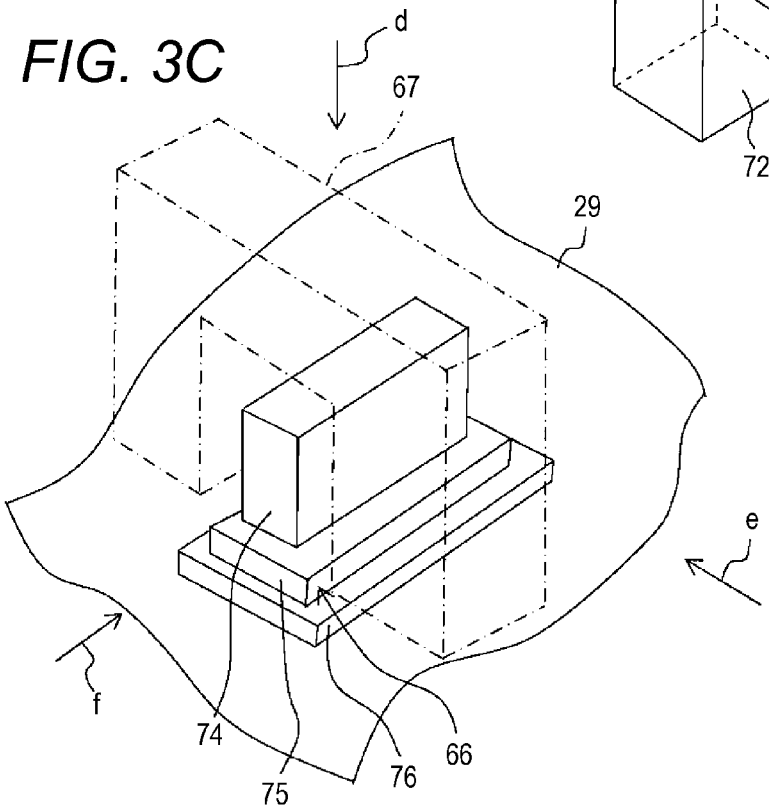
FIG. 3C is an enlarged perspective view illustrating a detection chamber of FIG. 3A and a positional relation between the detection chamber and the waste toner fullness sensor.

FIG. 3A is a perspective view illustrating only the waste toner collection container 29 and waste toner conveyance unit taken from the printer having the above configuration, in which the image forming device 2 and the transfer belt unit 3 are omitted, FIG. 3B is an enlarged perspective view of a waste toner fullness sensor 67 of FIG. 3A, and FIG. 3C is an enlarged perspective view illustrating a detection chamber 66 of FIG. 3A and a positional relation between the detection chamber 66 and the waste toner fullness sensor 67.

As shown in FIG. 3A, a waste toner conveyance unit 55 is arranged at a rear part of the apparatus main body 1. The waste toner conveyance unit 55 has a horizontal waste toner conveyance path 56 horizontally arranged to be long in a lateral direction, an inclined waste toner conveyance path 57 continuing to the horizontal waste toner conveyance path 56, and a waste toner discharge conveyance path 58 continuing to the inclined waste toner conveyance path 57 and bent forwards at a substantially right angle.

The horizontal waste toner conveyance path 56 is coupled with vertical drum waste toner conveyance units 59 (59*y*, 59*m*, 59*c*, 59*k*) formed at positions corresponding to waste toner discharge openings of the cleaners 11 of the image forming units 9. Upper-front surfaces of the vertical drum waste toner conveyance units 59 are formed with waste toner accommodation openings 61, respectively.

The cleaner 11 of the image forming unit 9 is configured to remove the waste toner from the circumferential surface of the photosensitive drum 10 configured to develop the toner image and to execute the primary transfer, and to discharge the removed waste toner from the discharge opening to the waste toner accommodation opening 61, as shown with an arrow 'b'.

The waste toner conveyance path 57 is coupled with a vertical belt waste toner conveyance unit 62 formed at a position corresponding to the belt cleaner 27 shown in FIG. 1. An upper-front surface of the vertical belt waste toner conveyance unit 62 is formed with a waste toner accommodation opening 63. The belt cleaner 27 is configured to remove the waste toner from the circumferential surface of the transfer belt 8 and to discharge the removed waste toner from a discharge opening to the waste toner accommodation opening 63, as shown with an arrow 'c'.

An end portion opening of the waste toner discharge conveyance path 58 forms a waste toner discharge opening although it is concealed and thus is not seen in the drawings. The waste toner discharge opening is coupled to a waste toner collection opening 64 of the waste toner collection container 29 when the waste toner collection container 29 is mounted to the mounting unit.

The waste toner collection opening 64 is formed at an upper center of the waste toner collection container 29. The waste toner discharge opening of the end portion opening of the waste toner discharge conveyance path 58 is provided with a shutter 65 for a case where the coupling of the waste toner collection container 29 with the waste toner collection opening 64 is released such as a case of replacing the waste toner collection container 29 with a new one.

Also, an upper-left side of a rear end of the waste toner collection container 29 is provided with a detection chamber 66 made of a transparent member with respect to sensor light and protruding outwards. A waste toner fullness sensor 67 consisting of an optical sensor is arranged to straddle an objective detected window part 74 of the detection chamber 66.

When the waste toner in the waste toner collection container 29 reaches a predetermined amount and enters the objective detected window part 74 of the detection chamber 66 to interrupt a sensor optical axis, the waste toner fullness sensor 67 determines that the waste toner in the waste toner collection container 29 reaches the predetermined amount.

In the waste toner conveyance unit 55, a conveying screw is embedded. The conveying screw is coupled to a conveyance gear 68 arranged at a right end portion of the horizontal waste toner conveyance path 56. The conveyance gear 68 is configured to rotate with being meshed with a driving system gear (not shown) of the apparatus main body.

The conveying screw is configured to rotate by the conveyance gear 68, to convey the waste toner, which is delivered from the vertical drum waste toner conveyance unit 59 to the horizontal waste toner conveyance path 56, and the waste toner, which is delivered from the vertical belt waste toner conveyance unit 67 to the inclined waste toner conveyance path 57, to the waste toner discharge opening of the end portion opening of the waste toner discharge conveyance path 58, and to discharge the waste toners to the waste toner collection opening 64 of the waste toner collection container 29.

A front surface of the waste toner collection container 29 is attached with a horizontally long knob 69, which serves as a knob when taking the waste toner collection container 29 in and out from the mounting unit, and a rotary knob consisting of a rotary body 71 to which the knob 69 is fixed. FIG. 3A illustrates a state where the waste toner collection container 29 is detachably mounted to the mounting unit in a longitudinal direction of the waste toner collection container 29, and the rotary knob 69 on the front surface is turned to a horizontal lock position.

In the waste toner collection container 29, an agitation gear (not shown) is arranged. The agitation gear is configured to rotate with being meshed with the driving system gear (not shown) of the apparatus main body and to uniformly deposit the waste toner discharged therein from the waste toner collection opening 64.

The waste toner fullness sensor 67 is an optical sensor of a light transmission type, and is fixed to a frame of the apparatus main body by a support part (not shown). The waste toner fullness sensor 67 has a shape where cuboids are coupled into a U shape, as shown in FIG. 3B and FIG. 3C, and a light emitting unit 72 is provided at one end portion of the U shape and a light receiving unit 73 is provided at the other end portion.

The detection chamber 66 is made of a material through which the light emitted from the light emitting unit 72 of the waste toner fullness sensor 67 can pass. When the light emitted from the light emitting unit 72 is usual light, the detection chamber consists of a transparent member, and when the light is infrared light, the detection chamber consists of a member through which the infrared light can pass. In the illustrative embodiment, the sensor of usual light is used.

The detection chamber 66 has the hollow objective detected window part 74 arranged at the uppermost part, a stepped part 75 continuing to a lower part of the objective detected window part 74 and slightly protruding outwards around the lower part, and a fixation part 76 continuing to a lower part of the stepped part 75 and slightly protruding outwards around the lower part.

Although described in detail later, the fixation part 76 is arranged to cover a notched opening of the waste toner collection container 29, and is arranged at a position at which the objective detected window part 74 of the detection chamber 66 is fitted in the U-shaped opening of the waste toner fullness sensor 67, as shown in FIG. 3*c*, when the waste toner collection container 29 is mounted to the mounting unit, as shown in FIG. 3A. Further, the waste toner fullness sensor 67 is arranged so that a detection light path 85 (optical axis) of the waste toner fullness sensor 67 is perpendicular to an attaching and detaching direction of the waste toner collection container 29.

FIG. 4A, FIG. 4B, FIG. 4C and FIG. 4D illustrate an internal configuration of the detection chamber 66, an engagement relation between the detection chamber 66 and the waste toner collection container 29, and an aspect of the waste toner fullness detection mechanism. Meanwhile, in FIG. 4A, FIG. 4B, FIG. 4C and FIG. 4D, the same constitutional parts as the configurations shown in FIG. 3B and FIG. 3C are denoted with the same reference numerals as FIG. 3B and FIG. 3C.

Figure 4A:
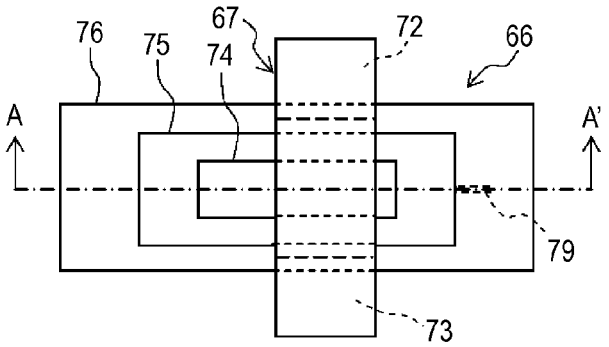
FIG. 4A, FIG. 4B, FIG. 4C and FIG. 4D illustrate an internal configuration of the detection chamber of the waste toner collection container according to the first illustrative embodiment, an engagement relation between the detection chamber and the waste toner collection container, and an aspect of a waste toner fullness detection mechanism.

Also, FIG. 4A is a plan view, as seen from an arrow 'd' of FIG. 3C, in which the waste toner collection container 29 is not shown. FIG. 4B is an A-A' sectional view of FIG. 4A, as seen from an arrow 'e' of FIG. 3C, in which an engaging part of the waste toner collection container 29 with the detection chamber 66 is also shown.

Figure 4C:
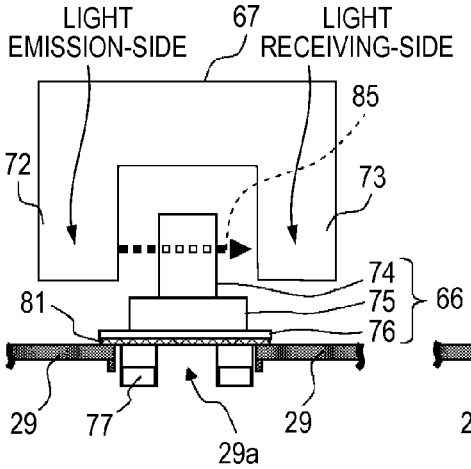
Figure 4B:
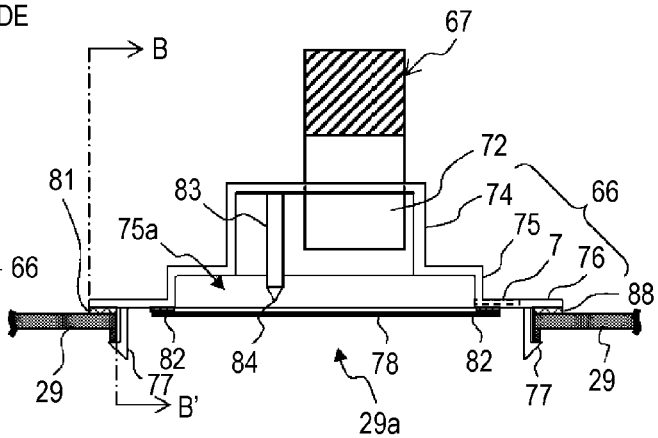
Figure 4D:
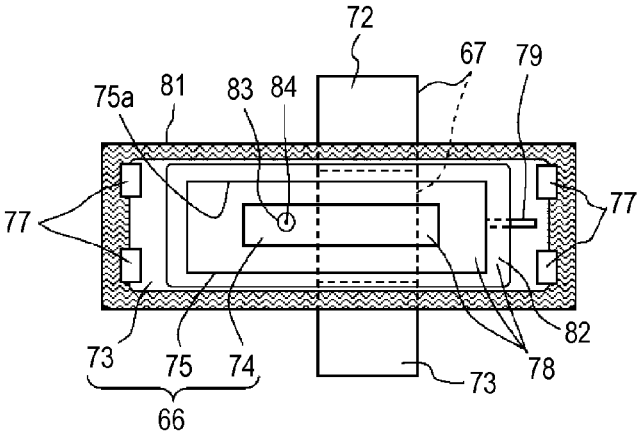

Also, FIG. 4C is a B-B' sectional view of FIG. 4B, as seen from an arrow 1' of FIG. 3C. FIG. 4D is a bottom view of FIG. 4A. The waste toner collection container 29 to which the detection chamber 66 is engaged has a housing main body (hereinafter, referred to as housing main body 29) having a shape (FIG. 3A) of the waste toner collection container 29 itself for collecting the waste toner.

As shown in FIG. 4B, FIG. 4C and FIG. 4D, detection chamber fitting claws 77 formed at end portions of a lower surface of the fixation part 76 of the detection chamber 66 are engaged at an edge of an inner-upper opening of the housing main body 29, thereby fixing the detection chamber 66 to an inner-upper opening 29*a* of the housing main body 29.

The fixation part 76 of the detection chamber 66 fixed to the opening 29*a* of the housing main body 29 has an opening 75*a* that has a size corresponding to the opening 29*a* of the housing main body 29 and is formed toward the inside of the housing main body 29. A width of the opening 75*a* of the detection chamber is sealed with a thin film 78. The stepped part 75 of the detection chamber 66 forms a width of the objective detected window part 74, which is an opening slightly smaller than the opening 75*a* of the fixation part 76, above the opening of the fixation part 76, and the objective detected window part 74 has a size appropriate to a U-shaped detection width size of the waste toner fullness sensor 67.

In general, the thin film is required to be strong. However, in the illustrative embodiment, since the thin film is fractured to exhibit a function thereof, the thin film may be weak in terms of the strength. As the thin film 78 of the illustrative embodiment, a thin film made of PLA resin (biodegradable plastic), polyester, polyvinylidene fluoride, cellophane, starch, paper, ceramics, glass and the like is used.

As for the PLA resin, polyester and the like, which are raw materials of the toner, the thin film may be formed using the toner material. In this case, the thin film may be formed using the image forming apparatus. Also, it is possible to reduce the labor of classifying the materials when recycling the waste toner collection container 29.

Also, thin film 78 is preferably non-transparent. In this case, it is possible to prevent an influence of disturbance light on the waste toner fullness sensor 67 even when the housing main body 29 is made to be transparent or semi-transparent.

Also, a size (size covering the opening 75*a*) of the thin film 78 and a thickness thereof are set so that, when the waste toner is collected in the housing main body 29 until the waste toner reaches a prescribed amount, the thin film is fractured by a pressing force of the waste toner and the waste toner can be thus introduced into the objective detected window part 74 of the detection chamber 66 through the fractured part. That is, a width of an opening, which is to be sealed by a waste toner introduction inhibition member, is formed to be larger than the width of the objective detected window part 74.

Also, at this time, when the thin film 78 is made of a material having no ventilation property, the fixation part 76 is formed with a ventilation groove 79 configured to communicate with an inside of the stepped part 75 so that the air in the detection chamber 66 can ventilate an inside of the housing main body 29 so as for the thin film 78 not to repel against the pressing force of the waste toner.

The ventilation groove 79 is formed to have a width of about 1 mm and a depth of about 0.1 mm, is configured to enable the air in the detection chamber 66 to escape into the housing main body 29 upon the deformation of the thin film 78, and is formed to be shallow so that when the waste toner to be collected to the housing main body 29 is the waste toner capable of falling in the internal space, it cannot pass therethrough. In the meantime, when the thin film 78 is made of paper or porous ceramics, the thin film has the ventilation property, so that the ventilation groove 79 is not required.

Although the description order has been reversed, the detection chamber 66 is fixed to the housing main body 29 by the detection chamber fitting claws 77 of the fixation part 76, and a detection chamber sealing sponge 81 (seal member) inserted between an edge periphery of the fixation part 76 and an opening edge periphery of the housing main body 29 seals a gap therebetween. The detection chamber sealing sponge 81 is an independent bubble structure so as to prevent the toner leakage.

Also, an edge periphery of the thin film 78 is bonded and fixed to an opening periphery of the stepped part 75 by a thin film adhesive 82. Also, a pin-shaped stress concentration member 83 extending up to a position adjacent to an opening surface of the stepped part 75 is arranged on the inner upper surface of the objective detected window part 74.

A tip 84 of the stress concentration member 83 is sharp, like a needle. Even though the pressing force of the waste toner is weak, the thin film 78 rises by the pressing force of the waste toner, contacts the tip 84 of the stress concentration member 83 and is thus fractured. When the thin film 78 is made of a material that is difficult to be fractured only by the pressing force and is easily stretchable, it is possible to effectively concentrate the stress.

On the other hand, when the thin film 78 is made of a thick material, a configuration where the thin film 78 is formed with a slitted groove (stress concentration part), and the stress concentration part of the thin film 78 contacting the tip 84 of the stress concentration member 83 sensitively reacts with the stress and is thus easily fractured may also be possible. Also, the tip 84 of the stress concentration member 83 may have a knife shape having an oblique ridge line, rather than the needle shape, depending on the material of the thin film 78. In this way, even the thin film 78 made of the easily stretchable material can be easily fractured.

Also, the thin film 78 is configured as a module integrated with the detection chamber 66, and the detection chamber 66 can be simply replaced in a module unit with respect to the housing main body 29. Therefore, it is possible to easily recycle the housing main body 29.

By the above configuration, when the waste toner is collected to the waste toner collection container 29, the waste toner falls in the internal space of the housing main body 29 before the waste toner reaches a predetermined amount in the housing main body 29. At this time, the thin film 78 inhibits the falling waste toner from being introduced into the detection chamber 66.

Then, the waste toner in the housing main body 29 reaches a predetermined amount and the waste toner presses the thin film 78 from below. By the pressing, the stress concentration part of the thin film 78 contacting the tip 84 of the stress concentration member 83 reacts with the stress and is thus fractured. Through the fractured part, the waste toner is introduced to the objective detected window part 74 of the detection chamber 66.

When the waste toner is introduced into the objective detected window part 74, the detection light path 85 (optical axis) of the waste toner fullness sensor 67 shown in FIG. 4C is interrupted by the waste toner. The waste toner fullness sensor 67 is configured to notify the control unit of the signal not received by the light receiving unit 73, as 'waste toner fullness signal'.

In the meantime, the positions of the light emitting unit 72 and light receiving unit 73 of the waste toner fullness sensor 67, i.e., the position of the detection light path 85 is changed depending on the design. For example, when it is intended to detect the signal at a position at which a container capacity of the objective detected window part 74 is 80%, the detection light path 85 is arranged at a position at which the light is interrupted at 80%.

Also, the waste toner fullness sensor 67 is configured to enable the light emitting unit 72 to emit the light only when the detection is required, so as to save the lifespan of the light emitting unit 72 and the energy. Also, the light emitting unit 72 is configured to drive in a PWM (pulse width modulation) manner so as to detect the signal after removing the influence of the disturbance light, and a correct received light quantity is obtained from a difference of received light quantities of the light receiving unit 73 upon the light emission and upon the non-light emission.

Figure 5A:
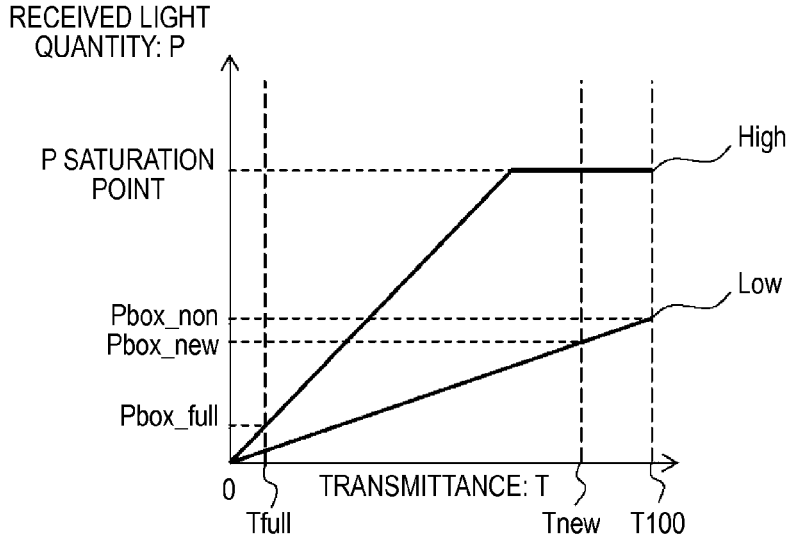
FIG. 5A shows relativity between the waste toner collection container according to the first illustrative embodiment and detection light of the waste toner fullness sensor.
Figure 5B:
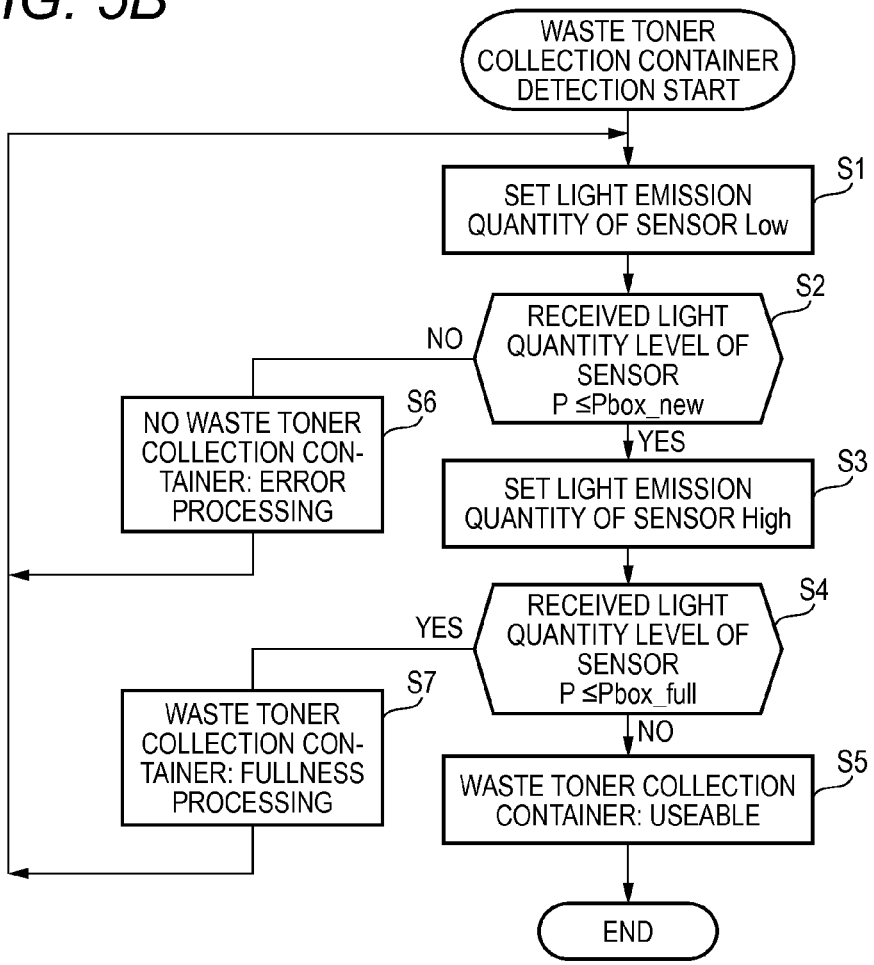
FIG. 5B is a flowchart showing a control of detecting whether the waste toner collection container is mounted or not and whether the waste toner reaches a predetermined amount after the waste toner collection container is mounted, based on the relativity.

FIG. 5A shows relativity between the waste toner collection container 29 and detection light of the waste toner fullness sensor 67, and FIG. 5B is a flowchart showing a control of detecting whether the waste toner collection container 29 is mounted or not and whether the waste toner reaches a predetermined amount after the waste toner collection container 29 is mounted, based on the relativity.

In FIG. 5A, a transmittance T of the light path of the waste toner fullness sensor 67 (hereinafter, simply referred to as sensor 67) to the light receiving unit 73 is shown on a horizontal axis, and a received light quantity P of the light receiving unit 73 is shown on a vertical axis. T100 on the horizontal axis indicates a light transmittance 100%, and the corresponding received light quantity P of the light receiving unit 73 of the sensor 67 is denoted with Pbox_non on the vertical axis.

The light transmittance 100% indicates that there is no member interrupting the light path of the sensor 67, in other words that the objective detected window part 74 is not arranged on the light path, i.e., the waste toner collection container 29 is not yet mounted to the mounting unit of the apparatus main body 1.

Also, Tnew on the horizontal axis of FIG. 5A indicates the light transmittance Tnew (%) of the objective detected window part 74 when a new waste toner collection container 29 is mounted to the mounting unit of the apparatus main body 1, and the corresponding received light quantity P of the light receiving unit 73 of the sensor 67 is denoted with Pbox_new on the vertical axis.

If a light emission quantity (detection light quantity) of the light emitting unit 72 of the sensor 67 is set High (strong) from the beginning, when a new objective detected window part 74, which is transparent and has a high light transmittance, is arranged or is not arranged, the received light quantity of the light receiving unit 73 of the sensor 67 reaches a saturation point P in any case, so that it is not possible to discriminate by the sensor whether the objective detected window part 74 is arranged or not.

Therefore, when starting to operate the apparatus main body 1, in order to determine whether the objective detected window part 74 of the new waste toner collection container 29 is arranged or not, the light emission quantity (detection light quantity) of the light emitting unit 72 of the sensor 67 is set Low (weak) so that the intensities of the light of light transmittance T100 upon the non-arrangement and the light of light transmittance Tnew upon the arrangement can be discriminated.

Thereby, the received light quantity of the light receiving unit 73 of the sensor 67 becomes the received light quantity Pbox_non at the light transmittance T100 indicating a state where the objective detected window part 74 is not arranged yet, and becomes the received light quantity Pbox_new lower than the received light quantity Pbox_non at the light transmittance Tnew indicating a state where the objective detected window part 74 is arranged. Thereby, it is possible to discriminate whether the objective detected window part 74 is arranged or not.

In this way, it is possible to discriminate whether the objective detected window part 74 of the new waste toner collection container 29 is arranged or not by the light emission quantity Low of the light emitting unit 72 of the sensor 67, which is set when starting to operate the apparatus main body 1. After detecting the received light quantity Pbox_new, which is the light quantity upon the arrangement, by the light receiving unit 73, the light emission quantity of the light emitting unit 72 of the sensor 67 is increased to the light emission quantity High.

Thereby, it is possible to detect a received light quantity Pbox_full by the light receiving unit at a light transmittance Tfull at the time that the objective detected window part 74 is almost filled with the waste toner, without causing an error.

Here, on the horizontal axis of FIG. 5A, Tfull indicates a light transmittance threshold of the objective detected window part 74 when the waste toner in the waste toner collection container 29 almost reaches a predetermined amount, Tnew indicates a light transmittance threshold of the objective detected window part 74 when a new waste toner collection container 29 is mounted, and T100 indicates the light transmittance 100% when the waste toner collection container 29 is not arranged, i.e., the sensor light path is opened.

Also, on the vertical axis of FIG. 5A, the received light quantity Pbox_non indicates a received light quantity of the light receiving unit 73 of the sensor 67 when there is no waste toner collection container 29 (light transmittance 100%), with respect to the light emission quantity Low (weak) of the light emitting unit 72 of the sensor 67.

Also, the received light quantity Pbox_new indicates a received light quantity threshold of the light receiving unit 73 of the sensor 67 when a new waste toner collection container 29 is mounted to the mounting unit (light transmittance Tnew %), with respect to the light emission quantity Low (weak) of the light emitting unit 72 of the sensor 67.

Also, the received light quantity Pbox_full indicates a received light quantity threshold of the light receiving unit 73 of the sensor 67 when the waste toner in the waste toner collection container 29 reaches a predetermined amount and the objective detected window part 74 is also filled with the waste toner (light transmittance Tfull %), with respect to the light emission quantity High (strong) of the light emitting unit 72 of the sensor 67.

Regarding the above settings, FIG. 5B is a flowchart showing a control of detecting whether the waste toner collection container 29 is mounted or not and whether the waste toner in the waste toner collection container 29 reaches a predetermined amount after the waste toner collection container 29 is mounted.

In the meantime, the detection processing is performed just after the apparatus main body 1 starts to operate and during the operation of the apparatus main body 1, as required.

In FIG. 5, the CPU 42 of the control device shown in FIG. 2 starts to determine whether the waste toner collection container 29 is mounted to the mounting unit. The CPU 42 first sets the light emission quantity of the light emitting unit 72 of the sensor 67 to the light emission quantity Low (step S1).

Subsequently, the CPU 42 determines whether the received light quantity P of the light receiving unit 73 of the sensor 67 is within a range of the received light quantity Pbox_new or lower, based on an output signal of the sensor 67 input from the sensor unit 48 to the input port 51 (step S2).

When the received light quantity P is within the range of the received light quantity Pbox_new or lower (Yes in step S2), the CPU determines that the objective detected window part 74 of the detection chamber 66 of the waste toner collection container 29 is arranged on the detection light path 85 of the sensor 67. In this case, the CPU 42 sets the light emission quantity of the light emitting unit 72 of the sensor 67 to the light emission quantity High (step S3).

Subsequently, the CPU 42 determines whether the received light quantity P of the light receiving unit 73 of the sensor 67 is within a range of the received light quantity Pbox_full or lower, based on an output signal of the sensor 67 input from the sensor unit 48 to the input port 51 (step S4).

When the received light quantity P exceeds the received light quantity Pbox_full (No in step S4), the CPU determines that objective detected window part 74 of the waste toner collection container 29 is not filled with the waste toner, i.e., the waste toner collection container 29 can be still used (step S5), and ends the detection processing.

In the determination of step S2, when the received light quantity P exceeds the received light quantity Pbox_new (No in step S2), the CPU determines that there is no member interrupting the detection light path 85 of the sensor 67, i.e., that the waste toner collection container 29 is not yet mounted to the mounting unit.

In this case, the CPU 42 displays a message 'no waste toner collection container' on the operation panel 38, performs error processing such as operation stop of the apparatus main body 1 (step S6), and returns to the processing of step S1.

Also, in the determination of step S4, when the received light quantity P is the received light quantity Pbox_full or lower (Yes in step S2), the CPU determines that the detection light path 85 of the sensor 67 is almost interrupted, i.e., that the objective detected window part 74 of the waste toner collection container 29 is almost filled with the waste toner.

In this case, the CPU 42 displays a message 'waste toner collection container is almost filled' on the operation panel 38, performs fullness processing such as operation stop of the apparatus main body 1 (step S7), and returns to the processing of step S1.

Like this, according to the illustrative embodiment, the light emitting unit 72 of the sensor 67 is configured to emit the light at the two levels (strong and weak) as regards the light emission quantity, and it is possible to determine whether the waste toner collection container 29 is mounted or not by the light emission quantity 'weak' and to determine whether the waste toner in the waste toner collection container 29 reaches a predetermined amount by the light emission quantity 'strong'.

The waste toner is not introduced into the objective detected window part 74 until the waste toner in the waste toner collection container 29 reaches a predetermined amount and the waste toner fractures the thin film 78 serving as the waste toner introduction inhibition member by the pressing force. Therefore, it is possible to prevent the erroneous detection of the sensor 67 due to the falling waste toner before the waste toner reaches the predetermined amount.

[Second Illustrative Embodiment]

FIG. 6A, FIG. 6B, FIG. 6C, FIG. 6D and FIG. 6E illustrates an internal configuration of a detection chamber of a waste toner collection container according to a second illustrative embodiment, an engagement relation between the detection chamber and the waste toner collection container, and an aspect of the waste toner fullness detection mechanism. Meanwhile, in FIG. 6A, FIG. 6B, FIG. 6C, FIG. 6D and FIG. 6E, the same configurations or functions as the configurations shown in FIG. 4A, FIG. 4B, FIG. 4C and FIG. 4D are denoted with the same reference numerals as FIG. 4A, FIG. 4B, FIG. 4C and FIG. 4D.

Figure 6A:
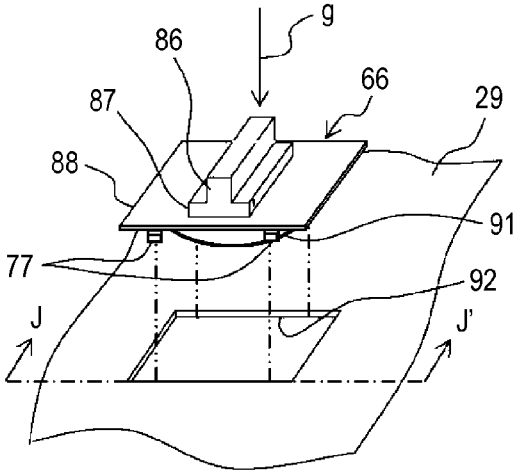
FIG. 6A, FIG. 6B, FIG. 6C, FIG. 6D and FIG. 6E illustrate an internal configuration of the detection chamber of the waste toner collection container according to a second illustrative embodiment, an engagement relation between the detection chamber and the waste toner collection container, and an aspect of the waste toner fullness detection mechanism.
Figure 6B:
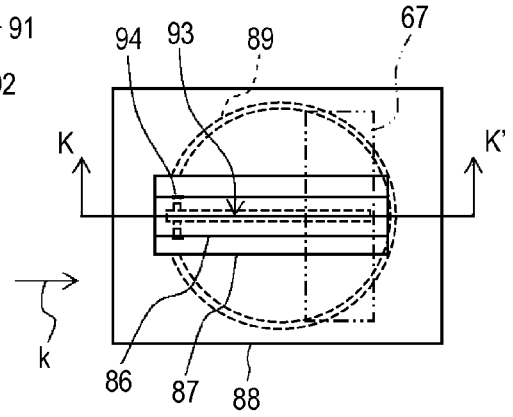

Also, FIG. 6A is a perspective view of an outward appearance of the detection chamber 66, illustrating a state just before the detection chamber is engaged with the waste toner collection container 29. FIG. 6B is a plan view of FIG. 6A, as seen from an arrow 'g' direction, in which the waste toner collection container 29 is not shown.

Figure 6C:
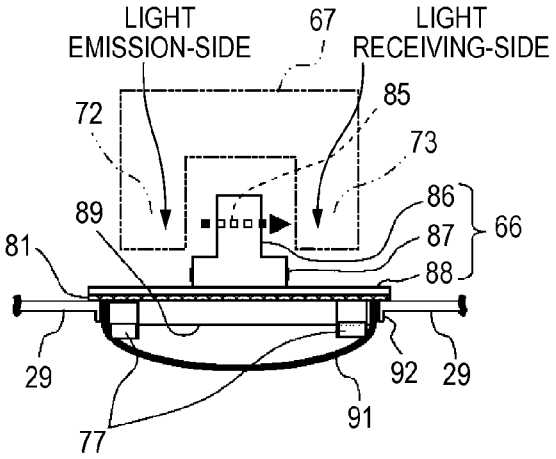
Figure 6D:
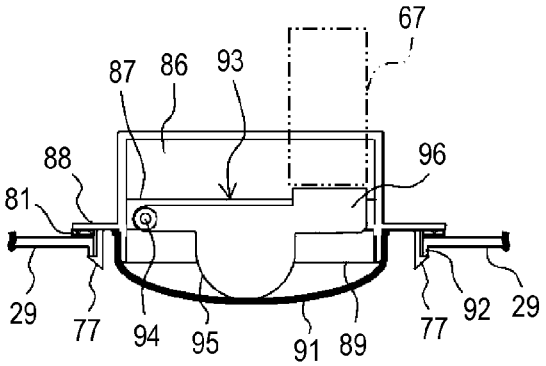
Figure 6E:
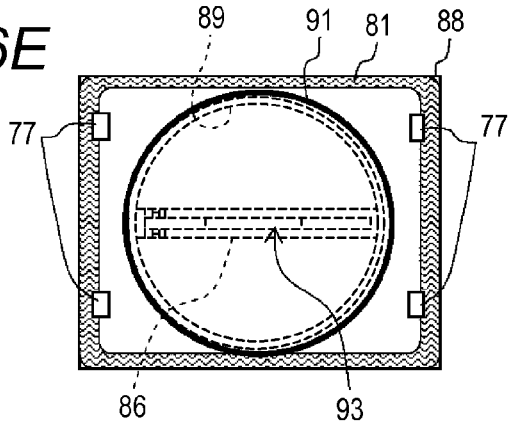

Also, FIG. 6C is a J-J' sectional view of FIG. 6A, as seen from an arrow 'k' direction of FIG. 6B and FIG. 6D is a K-K' sectional view of FIG. 6B. In FIG. 6C and FIG. 6D, an engaging part of the waste toner collection container 29 with the detection chamber 66 is also shown. FIG. 6E is a bottom view of FIG. 6B.

As shown in FIG. 6A, FIG. 6C and FIG. 6D, the detection chamber 66 of this illustrative embodiment has a objective detected window part 86 arranged at the uppermost part, which is elongated laterally, a stepped part 87 coupled to a lower part thereof and extending in a width direction of the objective detected window part 86, and a fixation part 88 coupled at a periphery of a lower part of the stepped part 87 and extending in all directions.

A lower surface of the fixation part 88 is integrally formed with a circular ring-shaped body 89 having substantially the same diameter as a length of the objective detected window part 86 in the longitudinal direction. An elastic film 91 serving as the waste toner introduction inhibition member and having a reversed shape of a brimless hat is externally fitted to the circular ring-shaped body 89 at an edge of the hat shape and is fixed by an elastic force of the elastic film 91.

The lower surface of the fixation part 88 is provided at its end portions of two sides facing each other with two pairs of detection chamber fitting claws 77. An upper part of the detection chamber 66 above the fixation part 88 is exposed to an outside of the waste toner collection container 29 (hereinafter, referred to as housing main body 29), and a lower part thereof below the bottom of the fixation part 88 is arranged in the housing main body 29.

As shown in FIG. 6C and FIG. 6D, the fixation part 88 is fixed to the housing main body 29 by engaging the detection chamber fitting claws 77 to an edge of the opening 92 of the housing main body 29. A detection chamber sealing sponge 81 (seal member) is mounted between the edge of the opening 92 of the housing main body 29 and a peripheral edge of the bottom of the fixation part 88.

The detection chamber sealing sponge 81 is configured to seal the opening 92 of the housing main body 29 from the outside. In the detection chamber 66, an interruption member 93 is provided between the elastic film 91 and the objective detected window part 86. The interruption member 93 consists of a thin plate-shaped non-transparent member.

As shown in FIG. 6B and FIG. 6D, the interruption member 93 is configured to rotatably keep one end at the stepped part 87 via a support shaft 94. The other end-side of the interruption member 93, rather than the support shaft 94-side, is formed at its central portion with a downward semicircular protrusion 95, and an angled plate-shaped protrusion 96 is formed at an end portion, as shown in FIG. 6D. That is, when the interruption member 93 is rotated about the support shaft 94, the angled plate-shaped protrusion 96

(working point protrusion) more moves than the semicircular protrusion 95 (force point protrusion).

Figure 7A:
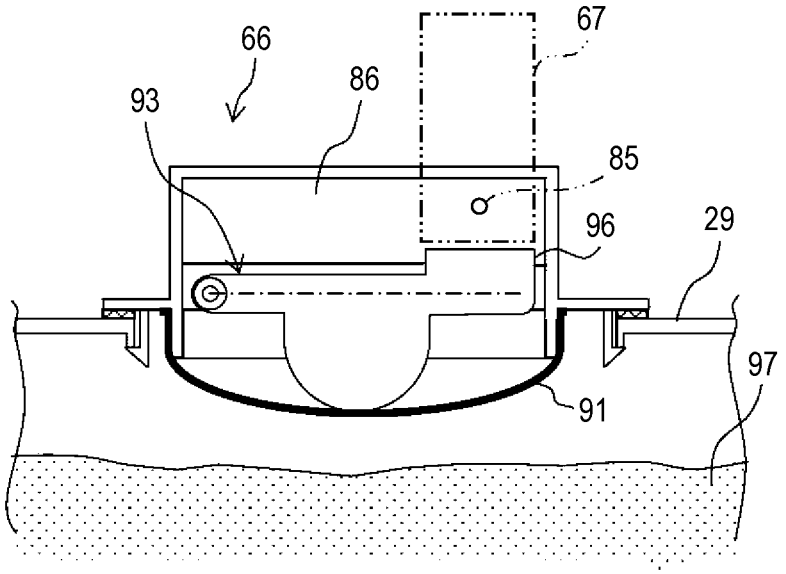
Figure 7B:
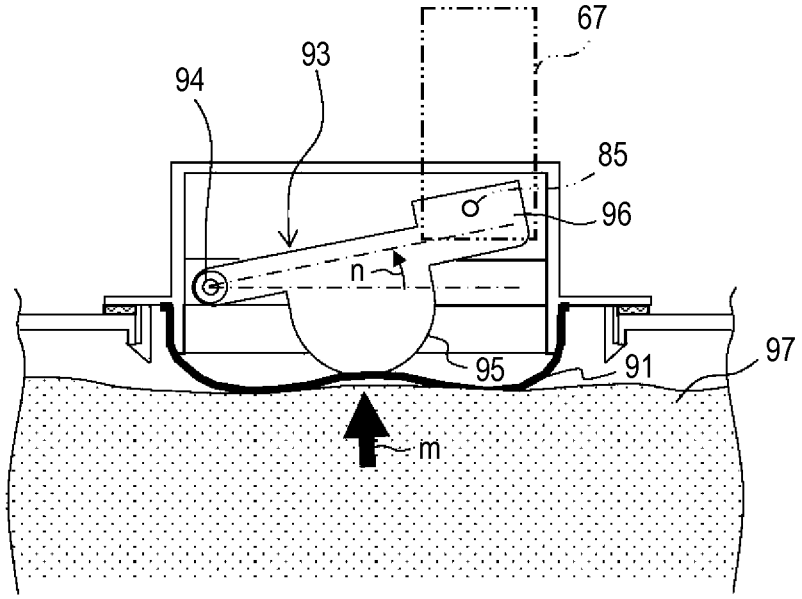

FIG. 7A and FIG. 7B illustrate operating states of the interruption member 93, in which FIG. 7A again illustrates the configuration shown in FIG. 6D together with the waste toner, which has not reached a predetermined amount in the housing main body 29, and FIG. 7B illustrates a state where the waste toner in the housing main body 29 reaches the predetermined amount.

In the meantime, the detection chamber 66 shown in FIG. 7A and FIG. 7B is shown with the same sectional view as FIG. 6D. Also, in the sensor 67 shown with a virtual line of a dashed-two dotted line, a position of the detection light path 85 is also shown. Also, the elastic film 91 is a thin elastic film capable of interrupting the waste toner, and is made of a material, which is not easily fractured, for example silicon rubber. Also, at this time, the elastic film 91 may be colored to be non-transparent. In this case, even when the waste toner collection container 29 is configured to be transparent or semitransparent, it is possible to prevent the influence of the disturbance light on the waste toner fullness sensor 67.

As shown in FIG. 7A, the interruption member 93 is arranged so that an upper part of the angled plate-shaped protrusion 96 is flush with or slightly lower than an arrangement surface of a lower end portion of the sensor 67 before the waste toner in the housing main body 29 reaches a predetermined amount. Thereby, the angled plate-shaped protrusion 96 is located at a non-interruption position of the sensor 67 with respect to the light path 85 when the external force is not applied.

As shown in FIG. 7A, at a state where a space above the waste toner 97 is empty, before the waste toner 97 in the housing main body 29 reaches a predetermined amount, the elastic film 91 keeps a predetermined shape thereof with respect to the interruption member 93 so that the angled plate-shaped protrusion 96 is located at the non-interruption position.

Then, as shown in FIG. 7B, when the waste toner 97 in the housing main body 29 reaches the predetermined amount, the waste toner pushes up the elastic film 91, as shown with an arrow m. The pushed up elastic film 91 is deformed to push up the semicircular protrusion 95 (force point protrusion) of the interruption member 93.

Thereby, the interruption member 93 is rotated upwards about the support shaft 94 serving as a support point, as shown with an arrow 'n'. By the rotation, the angled plate-shaped protrusion 96 (working point protrusion) of the interruption member 93 is largely rotated upwards to interrupt the detection light path 85 of the sensor 67. That is, the elastic film 91, which is the waste toner introduction inhibition member, keeps the predetermined shape thereof so that the interruption member 93 is located at the non-interruption position before the waste toner reaches the predetermined amount. When the waste toner in the housing main body reaches the predetermined amount, the elastic film 91 is deformed to rotate the interruption member 93 to the interruption position by the pressing force of the waste toner toward the detection chamber 66 from below.

Then, the sensor 67 outputs an interruption signal of the detection light path 85 to the CPU 42 of the control device, as a waste toner fullness notifying signal. Also, only the angled plate-shaped protrusion 96 configured to interrupt the light path may be integrally formed with the elastic film 91 without using the unitary interruption member 93. In this case, in the material of the elastic film 91, a pigment such as carbon black may be contained to secure the light interruption property of the detection light path 85. In this way, according to the second illustrative embodiment, since there is no component to be fractured, it is not necessary to replace a component and only the waste toner has only to be removed for recycling.

Although the illustrative embodiments of the present invention have been described, the present invention is included in the inventions defined in the claims and equivalents thereto.

What is claimed is:

1. A waste toner collection container comprising:

a housing main body that collects waste toner in the housing main body;

a detection chamber that comprises a transparent member that is transparent with respect to sensor light of a sensor, and that is arranged at an inner-upper part of the housing main body such that a light path of the sensor passes through at least one area of the detection chamber;

an interruption member that is arranged in the detection chamber and that is rotatable about a support portion between a non-interruption position and an interruption position with respect to the light path of the sensor, the support portion being arranged in the detection chamber;

an opening that is formed at the detection chamber and that opens toward an inside of the housing main body; and a waste toner introduction inhibition member that is arranged to seal the opening, wherein the waste toner introduction inhibition member is configured:

to keep a predetermined shape thereof so that the interruption member is located at the non-interruption position before the waste toner in the housing main body reaches a predetermined amount; and to be deformed so as to rotate the interruption member to the interruption position by a pressing force of the waste toner toward the waste toner introduction inhibition member as the waste toner in the housing main body reaches the predetermined amount.

2. The waste toner collection container according to claim 1, wherein the waste toner introduction inhibition member is fixed by an elastic force of the waste toner introduction inhibition member.

3. The waste toner collection container according to claim 1, wherein the interruption member includes:

a support shaft that is rotatably supported at the support portion;

a force point protrusion that faces toward the waste toner introduction inhibition member; and a working point protrusion that interrupts the light path of the sensor, and wherein the support shaft is formed at a position so that a movement amount of the working point protrusion is greater than a movement amount of the force point protrusion when the waste toner introduction inhibition member rotates the interruption member.

4. An image forming apparatus comprising:

(i) a waste toner collection container including:

a housing main body that collects waste toner in the housing main body;

a detection chamber that comprises a transparent member that is transparent with respect to sensor light of a sensor, and that is arranged at an inner-upper part of the housing main body such that a light path of the sensor passes through at least one area of the detection chamber;

an interruption member that is arranged in the detection chamber and that is rotatable about a support portion between a non-interruption position and an interruption position with respect to the light path of the sensor, the support portion being arranged in the detection chamber;

an opening that is formed at the detection chamber and that opens toward an inside of the housing main body; and a waste toner introduction inhibition member that is arranged to seal the opening, wherein the waste toner introduction inhibition member is configured:

to keep a predetermined shape thereof so that the interruption member is located at the non-interruption position before the waste toner in the housing main body reaches a predetermined amount; and to be deformed so as to rotate the interruption member to the interruption position by a pressing force of the waste toner toward the waste toner introduction inhibition member as the waste toner in the housing main body reaches the predetermined amount, (ii) the sensor, which determines whether the interruption member has rotated to the interruption position; and (iii) a control unit that includes an input port which receives an output signal of the sensor, wherein the control unit enables a notifying device to notify that the waste toner in the waste toner collection container has reached the predetermined amount, based on the signal input to the input port.

5. The image forming apparatus according to claim 4, wherein the waste toner collection container is arranged to be detachably mounted in one direction with respect to the image forming apparatus, and wherein the sensor is arranged so that an optical axis of the sensor is orthogonal to the direction.

6. The image forming apparatus according to claim 4, wherein the sensor is configured:

to measure a transmission light quantity by detection light quantities of multiple levels;

to determine whether the waste toner has reached the predetermined amount by a predetermined detection light quantity; and to determine whether the waste toner collection container is mounted in the image forming apparatus by a detection light quantity less than the predetermined light quantity.

7. The image forming apparatus according to claim 4, wherein the sensor includes a light emission unit and a light receiving unit, wherein the sensor drives the light emission unit by a pulse width modulation (PWM) method, and wherein the sensor obtains a correct received light quantity based on a difference of received light quantities of the light receiving unit at a light emission timing and received light quantities of the light receiving unit at a non-light emission timing.

8. The image forming apparatus according to claim 4, wherein a transmission light quantity is detected by a detection light quantity of the sensor less than a predetermined detection light quantity, wherein the control unit determines whether the waste toner collection container is mounted in the image forming apparatus, based on the transmission light quantity, and wherein when the control unit determines that the waste toner collection container is not mounted in the image forming apparatus, the notifying device notifies that the waste toner collection container is not mounted in the image forming apparatus.

* * * * *